US010743396B1

(12) United States Patent
Kawase

(10) Patent No.: US 10,743,396 B1
(45) Date of Patent: Aug. 11, 2020

(54) X-RAY GENERATION APPARATUS AND X-RAY IMAGING APPARATUS

(71) Applicant: CANON ANELVA CORPORATION, Kawasaki-shi, Kanagawa-ken (JP)

(72) Inventor: Junya Kawase, Yokohama (JP)

(73) Assignee: CANON ANELVA CORPORATION, Kawasaki-Shi, Kanagawa-Ken (JP)

( * ) Notice: Subject to any disclaimer, the term of this patent is extended or adjusted under 35 U.S.C. 154(b) by 0 days.

(21) Appl. No.: 16/821,495

(22) Filed: Mar. 17, 2020

Related U.S. Application Data

(63) Continuation of application No. PCT/JP2019/016194, filed on Apr. 15, 2019.

(51) Int. Cl.
*H01J 35/16* (2006.01)
*H05G 1/06* (2006.01)
(Continued)

(52) U.S. Cl.
CPC ..... *H05G 1/06* (2013.01); *H01J 35/025* (2013.01); *H01J 35/16* (2013.01); *H05G 1/32* (2013.01)

(58) Field of Classification Search
CPC .... A61B 6/00; A61B 6/44; H01J 35/00; H01J 35/02; H01J 35/025; H01J 35/04; H01J 35/06; H01J 35/08; H01J 35/16; H01J 35/165; H01J 35/32; H01J 2235/00; H05G 1/00; H05G 1/02; H05G 1/06; H05G 1/08;
(Continued)

(56) References Cited

U.S. PATENT DOCUMENTS 4,694,480 A 9/1987 Skillicorn
2013/0114794 A1 5/2013 Yamamoto
(Continued)

FOREIGN PATENT DOCUMENTS

JP 2012028093 A 2/2012
JP 2016539484 A 12/2016
(Continued)

OTHER PUBLICATIONS

International Search Report (with English Translation) and Written Opinion issued in corresponding International Patent Application No. PCT/JP2019/016194, 14 pages (dated Jul. 2, 2019).

*Primary Examiner* — Jurie Yun
(74) *Attorney, Agent, or Firm* — Buchanan Ingersoll & Rooney PC

(57) ABSTRACT

An X-ray generation apparatus includes an X-ray generation tube including a cathode having an electron emitting portion, and an anode having a target, a voltage supply supplying voltage to the X-ray generation tube via a conductive line, a storage container having a first portion forming a first space storing the voltage supply, a second portion forming a second space storing the X-ray generation tube, and a connecting portion connecting the first portion and the second portion, and an insulating liquid filling internal space of the storage container. The connecting portion includes a convex portion pointed toward the internal space. The cathode is arranged between the convex portion and the anode, and an insulating member is arranged to surround portion of the conductive line and block shortest path between the conductive line and the convex portion.

16 Claims, 4 Drawing Sheets

(51) Int. Cl.
*H05G 1/32* (2006.01)
*H01J 35/02* (2006.01)

(58) Field of Classification Search
CPC ..... H05G 1/10; A61N 2005/1022; A61N 2005/1019
USPC ..... 378/101, 119, 121, 122
See application file for complete search history.

(56) References Cited

U.S. PATENT DOCUMENTS

| | | | | |
|---|---|---|---|---|
| 2015/0098552 | A1 | 4/2015 | Draper et al. | |
| 2019/0150255 | A1* | 5/2019 | Kawase ..... | H01J 35/16 378/111 |

FOREIGN PATENT DOCUMENTS

| | | | |
|---|---|---|---|
| JP | 2018073625 | A | 5/2018 |
| JP | 2018206677 | A | 12/2018 |

* cited by examiner

X-RAY GENERATION APPARATUS AND X-RAY IMAGING APPARATUS

CROSS-REFERENCE TO RELATED APPLICATION(S)

This application claims priority to and the benefit of International Patent Application No. PCT/JP2019/016194, filed Apr. 15.2019, the entire disclosure of which is incorporated herein by reference.

BACKGROUND OF THE INVENTION

Field of the Invention

The present invention relates to an X-ray generation apparatus and an X-ray imaging apparatus.

Description of the Related Art

The enlargement ratio of an X-ray fluoroscopic image can increase as the distance between an object and a target that is an X-ray generation unit is short. There is known an X-ray generation apparatus in which to obtain a sufficient enlargement ratio even in a case in which the object is located at a deep position, a projecting portion which is long projecting from the main body portion of a storage container is provided on the main body portion, and an X-ray generation unit is attached to the distal end of the projecting portion. Such an X-ray generation apparatus is described in Japanese Patent Laid-Open No. 2018-73625.

In the X-ray generation apparatus as described above, a large potential difference is generated between the storage container and the cathode of the X-ray generation tube, and the storage container includes a bending portion formed at the connecting portion between the main body portion and the projecting portion. For this reason, discharge readily occurs between the bending portion of the storage container and the cathode of the X-ray generation tube. To solve this problem, Japanese Patent Laid-Open No. 2018-73625 describes arranging the bending portion between the cathode and the anode in the tube axis direction of the X-ray generation tube and making the distance between the bending portion and the cathode longer than the distance between the anode and the cathode. In addition, Japanese Patent Laid-Open No. 2018-73625 describes that when making the distance between the bending portion and the cathode shorter than the distance between the anode and the cathode, the bending portion is arranged between the cathode and the anode in the tube axis direction, and an insulating member is arranged so that the bending portion is not directly viewed from the cathode.

In both of the two approaches described in Japanese Patent Laid-Open No. 2018-73625, to reduce discharge between the bending portion of the storage container and the cathode of the X-ray generation tube, it is necessary to arrange the bending portion of the storage container between the anode-insulating tube joint portion (the joint portion between the anode and the insulating tube, outside the X-ray generation tube (on the oil side)) and the cathode-insulating tube joint portion (the joint portion between the cathode and the insulating tube, outside the X-ray generation tube (on the oil side)) in the tube axis direction. However, to improve the enlargement ratio when capturing an object arranged at a deeper position, the length of the projecting portion of the storage container is required to be increased. Japanese Patent Laid-Open No. 2018-73625 does not provide a solution to the requirement.

The present inventor found that the longer the distance between the bending portion and the cathode becomes in the structure in which the cathode is arranged, between the anode and the bending portion of the storage container, in the tube axis direction, the more unstable the operation of the X-ray generation apparatus becomes.

SUMMARY OF INVENTION

The present invention provides a technique advantageous in improving the enlargement ratio and improving the stability of the operation of an X-ray generation apparatus.

According to an aspect of the present invention, there is provided an X-ray generation apparatus, and the X-ray generation apparatus comprises an X-ray generation tube including a cathode having an electron emitting portion configured to emit electrons in a first direction, and an anode having a target configured to generate X-rays by the electrons radiated from the electron emitting portion colliding with the target, a voltage supply configured to supply a voltage to the X-ray generation tube via a conductive line, a storage container including a first portion configured to form a first space that stores the voltage supply, a second portion configured to form a second space whose width in a second direction orthogonal to the first direction is smaller than that of the first space and which stores the X-ray generation tube, and a connecting portion configured to connect the first portion and the second portion to each other so that the first space and the second space communicate with each other, and an insulating liquid that fills an internal space in which the first space and the second space communicate with each other, wherein the connecting portion includes a convex portion pointed toward the internal space, and in the first direction, the cathode is arranged between the convex portion and the anode, and an insulating member is arranged to surround at least a. portion of the conductive line and block at least a shortest path between the conductive line and the convex portion.

Further features of the present invention will become apparent from the following description of exemplary embodiments with reference to the attached drawings.

DESCRIPTION OF EMBODIMENTS

Figure 1:
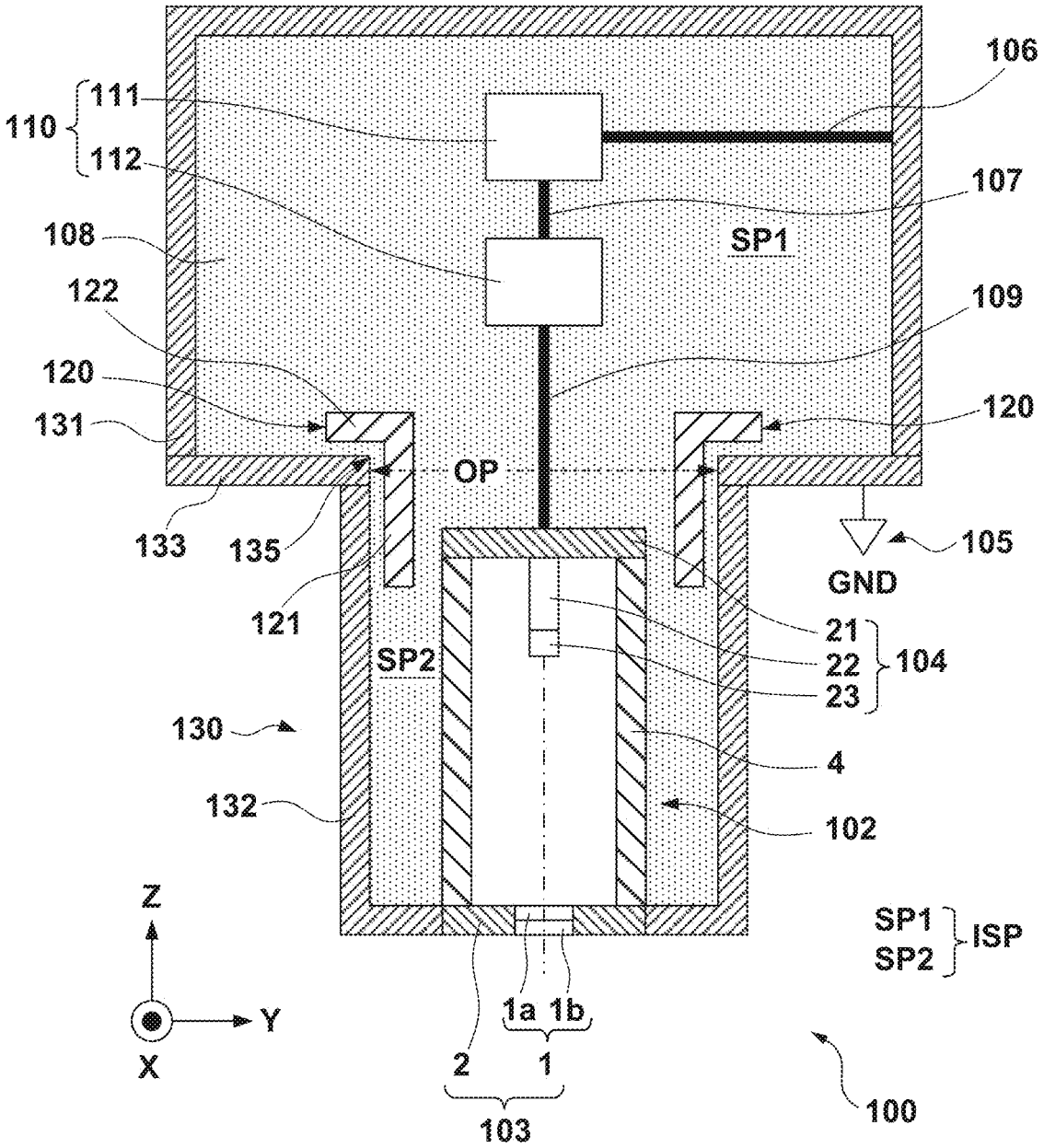
FIG. 1 is a view showing the arrangement of an X-ray generation apparatus according to the first embodiment.

Hereinafter, embodiments will be described in detail with reference to the accompanying drawings. It should be noted that the following embodiments are not intended to limit the scope of the appended claims. A plurality of features are described in the embodiments. However, not all the combinations of the plurality of features are necessarily essential to the present invention, and the plurality of features may arbitrarily be combined. In addition, the same reference numerals denote the same or similar parts in the accompanying drawings, and a repetitive description will be omitted.

FIG. 1 schematically shows the arrangement of an X-ray generation apparatus 100 according to the first embodiment. The X-ray generation apparatus 100 can include an X-ray generation tube 102, a voltage supply 110, a storage container 130 an insulating liquid 10$, and an insulating member 120. The X-ray generation tube 102 can include a cathode 104 including an electron emitting portion 23 that emits electrons in the first direction (Z direction) that is a tube axis direction, and an anode 103 including a target 1 that generates X-rays by the electrons radiated from the electron emitting portion 23 colliding the target 1. The voltage supply 110 supplies a voltage to the X-ray generation tube 102, more specifically, to the cathode 104 via a conductive line 109. The conductive line 109 can include a conductive member and an insulating member that covers the conductive member, but may not include the insulating member.

The storage container 130 can include a first portion 131, a second portion 132, and a connecting portion 133. The first portion 131 can store the voltage supply 110. The second portion 132 can store the X-ray generation tube 102. The connecting portion 133 can connect the first portion 131 and the second portion 132 to each other to form an internal space ISP in which a first space SP1 inside the first portion 131 and a second space SP2 inside the second portion 132 communicate with each other. The width of the second portion 132 in the second direction (Y direction) orthogonal to the first direction (Z direction) is smaller than that of the first portion 131. In addition, the width of the second space SP2 in the second direction (Y direction) orthogonal to the first direction (Z direction) is smaller than that of the first space SP1. The connecting portion 133 can include a convex portion 135 pointed toward the internal space ISP of the storage container 130. The second portion 132 can include, for example, a tubular shape such as a cylindrical shape. In a section of the convex portion 135 (for example, a sectional view like FIG. 1), the convex portion 135 may have an internal angle of 90° or an acute internal angle or an obtuse internal angle. In the first direction (Z direction), the cathode 104 of the X-ray generation tube 102 can be located between the convex portion 135 of the connecting portion 133 and the anode 103 of the X-ray generation tube 102.. In the example shown in FIG. 1, the length of the second portion 132 in the first direction (Z direction) is longer than that of the X-ray generation tube 102.

The insulating liquid 108 can fill the internal space ISP of the storage container 130 to be in contact with the cathode 104 and surround the conductive line 109, The insulating member 120 can be arranged in the internal space ISP of the storage container 130 to surround at least a portion of the conductive line 109. The insulating member 120 can be arranged to block at least the shortest path between the conductive line 109 and the convex portion 135 of the connecting portion 133. The insulating member 120 can be arranged to block the linear path between the conductive line 109 and the convex portion 135 of the connecting portion 133 in the whole path of the conductive line 109 between the voltage supply 110 and the cathode 104. The insulating member 120 can be a fixed member. The target 1 of the X-ray generation tube 102 stored in the second portion 132 can be located at the distal end (the lower end in FIG. 1) of the second portion 132. Since the target 1 is an X-ray generation portion that generates X-rays, the arrangement as described above is advantageous in making the X-ray generation portion close to an object, that is, improving the enlargement ratio at the time of imaging.

The X-ray generation tube 102 can be a transmission-type X-ray generation tube. The X-ray generation tube 102 can include the anode 103, the cathode 104, and an insulating tube 4. The anode 103, the cathode 104, and the insulating tube 4 constitute a vacuum airtight container. The insulating tube 4 has a tubular shape, for example, a cylindrical shape, and connects the anode 103 and the cathode 104 while insulating them from each other. The anode 103 can include the target 1 and an anode member 2. The target 1 can include a target 1, and a support window 1*b* that supports the target layer 1*a*. The anode member 2 can have an annular shape. The anode member 2. supports the target 1. The anode member 2 can electrically be connected to the target layer 1*a*. The anode member 2 and the support window 1*b* can be connected by, for example, a brazing material. In the example shown in FIG. 1, the target 1 and the distal end of the second portion 132 are arranged on the same plane. However, the target 1 may be arranged to project outward from the distal end of the second portion 132 or may be arranged to be recessed from the distal end of the second portion 132 as long as the target 1 is set at the same position as the second portion 132 (that is, grounded). The form in which the target 1 is located at the distal end of the second portion 132 can include such a form as well.

The target layer 1*a* contains, for example, a heavy metal such as tungsten or tantalum, and generates X-rays when irradiated with electrons. The thickness of the target layer 1*a* can be decided based on the balance between the electron penetration length that contributes to generation of X-rays and the self-attenuation amount when the generated X-rays pass through the support window 1*b*. The thickness of the target layer 1*a* can fall within the range of, for example, 1 μm to several ten μm.

The support window 1*b* has a function of passing the X-rays generated in the target layer 1*a* and discharging them out of the X-ray generation tube 102. The support window 1*b* can be made of a material that passes X-rays, for example, beryllium, aluminum, silicon nitride, or an allotrope of carbon. To effectively transmit heat generated in the target layer 1*a* to the anode member 2, the support window 1*b* can be made of, for example, diamond that has a high heat conductivity.

The insulating tube 4 can be made of a ceramic material such as alumina or zirconia having vacuum airtightness and insulating properties, soda lime, or a glass material such as silica. From a viewpoint of reducing the thermal stress with respect to the insulating tube 4, a cathode member 21 and the anode member 2 can be made of materials having linear expansion coefficients $\alpha c$ (ppm/° C.) and $\alpha a$ (ppm/° C.), respectively, which are close to a linear expansion coefficient $\alpha i$ (ppm/° C.) of the insulating tube 4. The cathode member 21 and the anode member 2 can be made of, for example, an alloy such as Kovar or Monel.

The cathode 104 can include the electron emitting portion 23, the cathode member 21, and a fixing portion 22 that fixes the electron emitting portion 23 to the cathode member 21. For example, to the cathode member 21, the electron emitting portion 23 may be connected via a brazing material, may thermally he fused by laser welding or the like, or may electrically be connected by another method. The electron emitting portion 23 can include an electron source such as an impregnated type thermion. source, a filament type thermion source, or a cold. cathode electron source. The electron emitting portion 23 can include an electrostatic lens electrode (not shown) such as an extraction grid electrode or a focusing lens electrode, which defines an electrostatic field. The fixing portion 22 can have a tubular shape that passes the conductive line 109 electrically connected to the electron source and the electrostatic lens electrode. The conductive line 109 can include a plurality of conductive members insulated from each other.

The X-ray generation apparatus 100 can be formed as an anode grounded type in which the anode 103 is grounded, in the anode grounded type, the anode 103 can electrically be connected to the storage container 130. The storage container 130 can electrically be connected to a ground terminal 105. The cathode 104 can electrically be connected to the voltage supply 110 via the conductive line 109.

The voltage supply 110 can include a power supply circuit 111, and a driving circuit 112 that receives power supplied from the power supply circuit 111 via a power supply line 107 and drives the X-ray generation tube 102 via the conductive line 109. The driving circuit 112 can electrically be connected to the storage container 130 via the power supply line 107, the power supply circuit 111, and a grounding wire 106. The driving circuit 112 can control the emitted electron amount from the electron source or the electron beam diameter by controlling voltages to be supplied to the electron source, the extraction grid electrode, the focusing lens electrode, and the like. The positive electrode terminal of the power supply circuit 111 is grounded via the ground wire 106 and the storage container 130, and the negative electrode terminal of the power supply circuit 111 is connected to the driving circuit 112 via the power supply line 107 to supply a negative voltage to the driving circuit 112. A control signal can be supplied to the driving circuit 112 from, for example, a control unit (not shown) arranged outside the storage container 130 via a cable such as an optical fiber cable.

The first portion 131, the second portion 132, and the connecting portion 133 which form. the storage container 130, can be made of a material with conductivity, electrically connected to each other, and grounded. This arrangement is advantageous in ensuring electrical safety. The first portion 131, the second portion 132, and the connecting portion 133 can be made of a metal material. The insulating liquid 108 can vacuum-fill the storage container 130. The reason for this is that if bubbles exist in the insulating liquid 108, a region whose dielectric constant is lower as compared to the insulating liquid 108 on the periphery is locally formed, resulting in discharge.

The insulating liquid 108 also has a function of suppressing discharge between the X-ray generation tube 102 and the storage container 130 and discharge between the voltage supply 110 (the power supply circuit 111 and the driving circuit 112) and the storage container 130. As the insulating liquid 108, a liquid having excellent heat resistance, liquidity, and electrical insulating properties in the operating temperature range of the X-ray generation apparatus 100, for example, a chemical synthetic oil such as silicone oil or fluororesin-based oil, a mineral oil, or the like can be used.

The X-ray generation tube 102 can be joined to the opening portion provided at the distal end (the lower end in FIG. 1) of the second portion 132 of the storage container 130 and thus fixed to the second portion 132. The space between the X-ray generation tube 102 and the inside surface of the second portion 132 can be filled with the insulating liquid 108. The power supply circuit 111 and the driving circuit 112 can be fixed to the first portion 131 of the storage container 130 by a fixing member (not shown). The power supply circuit 111 and the driving circuit 112 can be surrounded by the insulating liquid 108. The conductive line 109 can be surrounded by the insulating liquid 108.

The insulating member 120 can be arranged to surround at least part of the cathode 104, for example, the cathode member 21. The at least part of the cathode 104, for example, the cathode member 21 can be arranged to face the insulating member 120 via the insulating liquid 108. In (a sectional view on) a plane orthogonal to the first direction (Z direction), the at least part of the cathode 104, for example, the cathode member 21 can be arranged to face the insulating member 120 via the insulating liquid 108. In (the sectional view on) the plane, the insulating member 120 can face the second portion 132 via the insulating liquid 108.

The connecting portion 133 of the storage container 130 includes a plate portion spreading in a direction orthogonal to the first direction (Z direction), and the plate portion includes an opening OP through which the conductive line 109 passes. The plate portion can contact the attachment surface of a structure (for example, a housing) that supports the X-ray generation apparatus 100. Alternatively, the plate portion can be fitted in the opening of the structure that supports the X-ray generation apparatus 100. in the storage container 130, the side surface of the opening OP of the plate portion and the inner side surface of the second portion 132 can form a continuous surface without a step. In an example, the opening OP can be a circular opening, and the inner side surface of the second portion 132 can he a cylindrical surface. The convex portion 135 can be formed by the end of the opening OP.

The insulating member 120 includes a tubular portion 121 and a flange portion 122 extending along the plate portion of the connecting portion 133, and can have a structure in which one end of the tubular portion 121 and the flange portion 122 are connected. The flange portion 122 can be arranged, for example, in parallel to the plate portion of the connecting portion 133. The tubular portion 121 can be arranged to surround at least part of the insulating tube 4 of the X-ray generation tube 102. Here, the tubular portion 121 may be arranged to surround the whole insulating tube 4 or may be arranged to surround only part of the insulating tube 4. The flange portion 122 may be arranged such that the entire flange portion 122 or part of it is in contact with the connecting portion 133. In addition, the flange portion 122 may be arranged such that the entire flange portion 122 or part of it is in contact with the second portion 132.

The whole cathode 104 of the X-ray generation tube 102 can be arranged in the second space SP2. In another viewpoint, the cathode 104 of the X-ray generation tube 102 can be arranged between the anode 103 of the X-ray generation tube 102 and the opening OP of the connecting portion 133. in still another viewpoint, the cathode 104 of the X-ray generation tube 102 can be arranged such that the whole lateral side of the cathode 104 is surrounded by the second portion 132.

A virtual line (or conical surface) that connects one of the two ends of the conductive line 109 on the side of the voltage supply 110 (driving circuit 112) to the convex portion 135 can intersect the insulating member 120. A virtual line (or conical surface) that connects one of the two ends of the conductive line 109 on the side of cathode 104 to the convex portion 135 can intersect the insulating member 120. A virtual line that connects any position between the two ends of the conductive line 109 to the convex portion 135 can intersect the insulating member 120. A virtual line that connects the voltage supply 110 to the convex portion 135 can intersect the insulating member 120, In a physical space, the driving circuit 112 is arranged between the power supply circuit 111 and the cathode 104, and a virtual line that connects the driving circuit 112 to the convex portion 135 can intersect the insulating member 120.

if the insulating member 120 is not arranged to block the linear path between the conductive line 109 and the convex portion 135 of the connecting portion 133, the operation of the X-ray generation apparatus 100 becomes unstable along with an increase in the length of the second portion 132 in the first direction. The cause is considered to be a swing of the conductive line 109 caused by the flow of the insulating liquid 108, More specifically, the present inventor considered as follows. First, a flow of an insulating liquid that can occur using an electric field as a driving force is known as an EHD phenomenon. Along with the increase in the length of the second portion 132 of the ground potential in the first direction, the length of the conductive line 109 to which a voltage (negative potential) having a large potential difference with respect to the ground potential is applied is also increased. In other words, the surface areas of both electrodes (the second portion 132 and the conductive line 109) near the convex portion 135 where an electric field readily concentrates increase, and the contact area between the insulating liquid 108 and both the electrodes increases. With the increase in the contact area to both the electrodes, the EHD phenomenon is enhanced, and the convection speed of the insulating liquid 108 increases. Furthermore, the insulating liquid 108 fills both the first space SP1 and the second space SP2, which communicate with each other and in which electric fields different from each other are generated, and the driving force to cause convection of the insulating liquid 108 is complicated. These increase the swing of the conductive line 109. By this swing, the distance between the conductive line 109 and the convex portion 135 become short, and discharge is induced between the conductive line 109 and the convex portion 135. In addition, if the minimum radius of curvature of the conductive line 109 is smaller than the minimum radius of curvature of the cathode 104, the increase in the length of the conductive line 109 can more easily induce discharge between the conductive line 109 and the convex portion 135.

Such an unstable operation is solved by arranging the insulating member 120 to block the linear path between the conductive line 109 and the convex portion 135 of the connecting portion 133. As another solution, the dimension of the opening OP that defines the convex portion 135 is made large, thereby increasing the distance between the convex portion 135 and the conductive line 109. However, this method is not preferable because it leads to an increase in the size of the X-ray generation apparatus 100.

Figure 2:
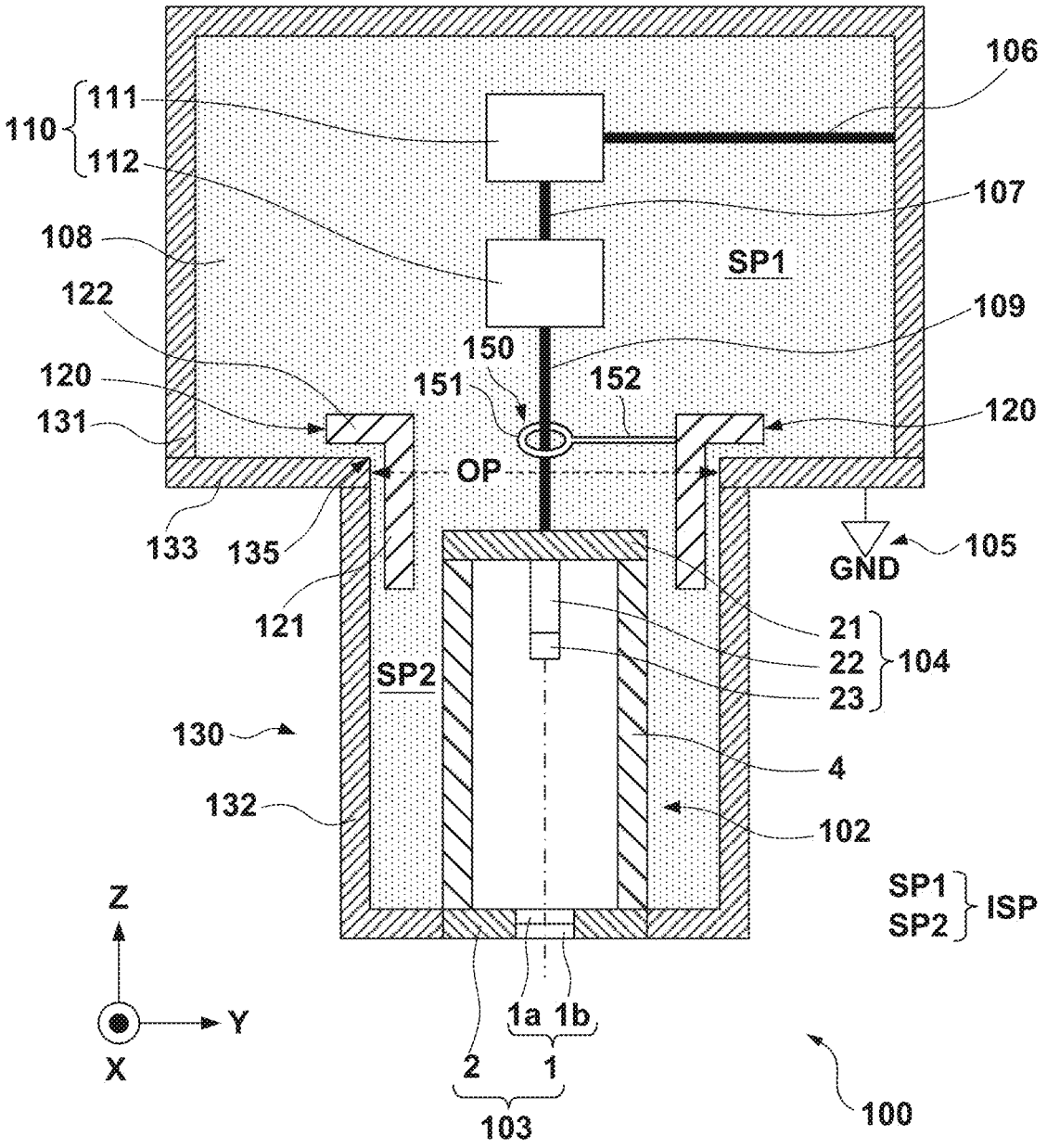
FIG. 2 is a view showing the arrangement of an X-ray generation apparatus according to the second embodiment.

An X-ray generation apparatus 100 according to the second embodiment will be described below with reference to FIG. 2. Matters that are not mentioned as the X-ray generation apparatus 100 according to the second embodiment can comply with the first embodiment. The X-ray generation apparatus 100 according to the second embodiment includes a regulating member 150 that limits the movement of a conductive line 109. The regulating member 150 can be arranged to fix or limit the position of a portion between the two ends of the conductive line 109 in the entire conductive line 109. The regulating member 150 can include, for example, a surrounding member 151 that regulates the position of the conductive line 109, and a. fixing member 152 that fixes the surrounding member 151. The fixing member 152 can be a connecting member that connects the surrounding member 151 and an insulating member 120. The fixing member 152 can directly be connected to the insulating member 120 without an intervention of a storage container 130. Alternatively, the fixing member 152 may directly be connected to the storage container 130. Otherwise, the fixing member 152 may be fixed to the insulating member 120 or the storage container 130 via another member. The regulating member 150 can be made of an insulator. The surrounding member 151 and the fixing member 152 can be made of an insulator.

The second embodiment is advantageous because the regulating member 150 that limits the movement of the conductive line 109 is provided, thereby suppressing discharge between the conductive line 109 and a convex portion 135 of a connecting portion 133 caused by the swing of the conductive line 109 and stabilizing the operation of the X-ray generation apparatus 100, Note that at least part of the effect of the second embodiment can be obtained even if the insulating member 120 is absent.

Figure 3:
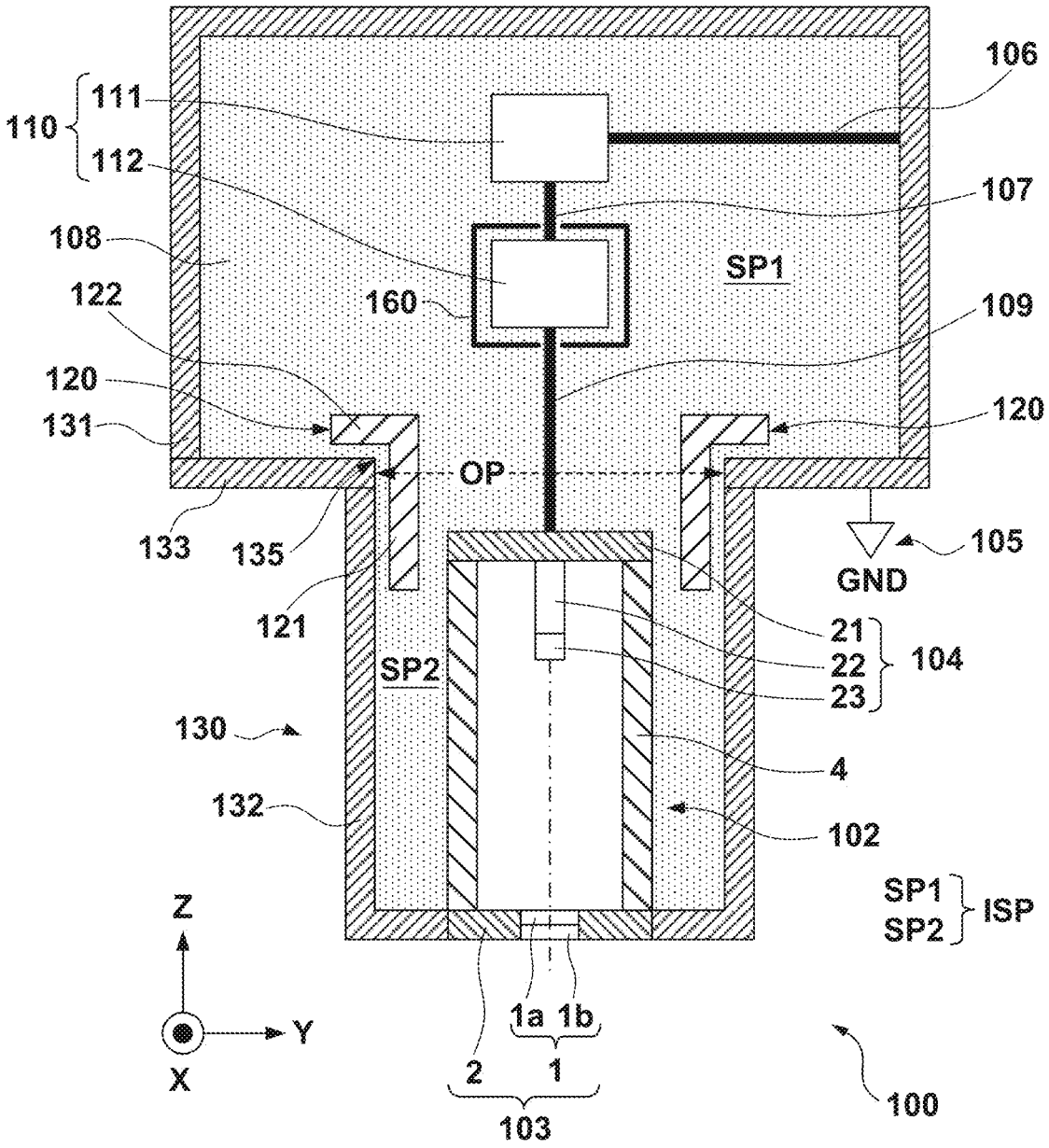
FIG. 3 is a view showing the arrangement of an X-ray generation apparatus according to the third embodiment.

An X-ray generation apparatus 100 according to the third embodiment will be described below with reference to FIG. 3. Matters that are not mentioned as the X-ray generation apparatus 100 according to the third embodiment can comply with the first or second embodiment. The X-ray generation apparatus 100 according to the third embodiment includes a conductive member 160 arranged in a first space SP1 to surround a driving circuit 112. The conductive member 160 can be maintained at a fixed potential. The conductive member 160 can be connected to, for example, the power supply terminal (a terminal maintained at a fixed potential) of a voltage supply 110. The conductive member 160 can include a through hole configured to pass the conductive lines 109 and 107. The conductive member 160 may surround a power supply circuit 111 in addition to the driving circuit 112. That is, the conductive member 160 may surround the voltage supply 110. An insulating liquid 108 can be arranged to surround the conductive member 160.

If the insulating liquid 108 causes convection in an internal space ISP of the storage container 130, friction occurs between the insulating liquid 108 and various kinds of insulators arranged in the internal space ISP, and the insulating liquid 108 and the insulators can be charged to polarities opposite to each other. If the convection speed of the insulating liquid 108 is increased by increasing the length of a second portion 132 in the first direction, the amount of charge caused by the friction also increases, and the driving circuit 112 in the insulating liquid 108 may cause an operation error. The conductive member 160 is advantageous in suppressing the operation error of the driving circuit 112 due to such a reason and stabilizing the operation of the X-ray generation apparatus 100.

Figure 4:
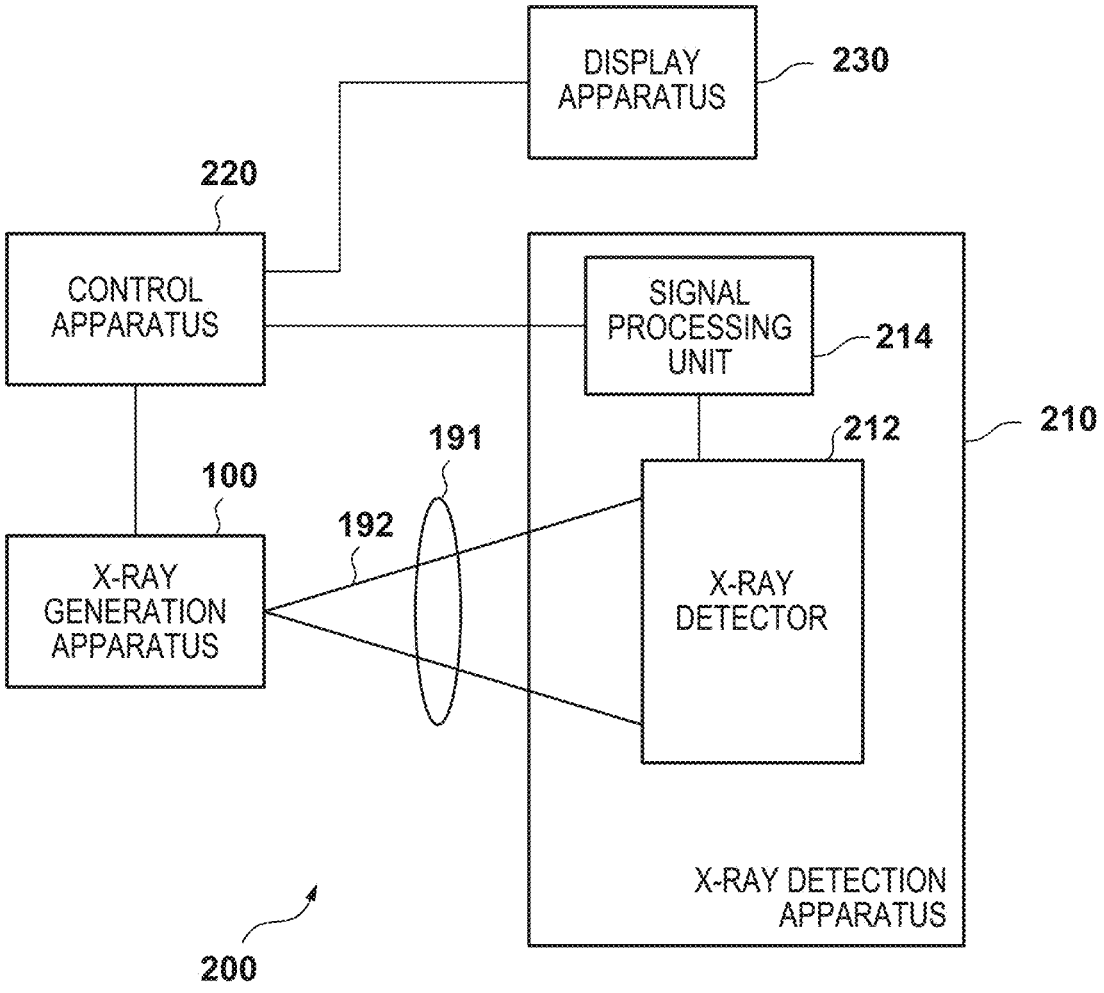
FIG. 4 is a view showing the arrangement of an X-ray imaging apparatus according to an embodiment.

FIG. 4 shows the arrangement of an X-ray imaging apparatus 200 according to an embodiment. The X-ray imaging apparatus 200 can include the X-ray generation apparatus 100, and an X-ray detection apparatus 210 that detects X-rays 192 radiated from the X-ray generation apparatus 100 and transmitted through an object 191. The X-ray imaging apparatus 200 may further include a control apparatus 220 and a display apparatus 230. The X-ray detection apparatus 210 can include an X-ray detector 212 and a signal processing unit 214. The control apparatus 220 can control the X-ray generation apparatus 100 and the X-ray detection apparatus 210. The X-ray detector 212 detects or captures the X-rays 192 radiated from the X-ray generation apparatus 100 and transmitted through the object 191. The signal processing unit 214 can process a signal output from the X-ray detector 212 and supply the processed signal to the control apparatus 220. The control apparatus 220 causes the display apparatus 230 to display an image based on the signal supplied from the signal processing unit 214.

The present invention is not limited to the above embodiments, and various changes and modifications can be made within the spirit and scope of the present invention. Therefore, to apprise the public of the scope of the present invention, the following claims are made.

What is claimed is:

1. An X-ray generation apparatus comprising:

an X-ray generation tube including a cathode having an electron emitting portion configured to emit electrons in a first direction, and an anode having a target configured to generate X-rays by the electrons radiated from the electron emitting portion colliding with the target:

a voltage supply configured to supply a voltage to the X-ray generation tube via a conductive line:

a storage container including a first portion configured to form a first space that stores the voltage supply, a second portion configured to form a second space whose width in a second direction orthogonal to the first direction is smaller than that of the first space and which stores the X-ray generation tube, and a connecting portion configured to connect the first portion and the second portion to each other so that the first space and the second space communicate with each other: and an insulating liquid that fills an internal space in which the first space and the second space communicate with each other, wherein the connecting portion includes a convex portion pointed toward the internal space, and in the first direction, the cathode is arranged between the convex portion and the anode, and an insulating member is arranged to surround at least a portion of the conductive line and block at least a shortest path between the conductive line and the convex portion.

2. The X-ray generation apparatus according to claim 1, wherein the insulating member is arranged to surround at least part of the cathode.

3. The X-ray generation apparatus according to claim 1, wherein at least part of the cathode faces the insulating member via the insulating liquid.

4. The X-ray generation apparatus according to claim 3, wherein in a plane orthogonal to the first direction, the at least part of the cathode faces the insulating member via the insulating liquid.

5. The X-ray generation apparatus according to claim 4, wherein in the plane, the insulating member faces the second portion via the insulating liquid.

6. The X-ray generation apparatus according to claim 1, wherein the connecting portion includes a plate portion spreading in a direction orthogonal to the first direction, and the plate portion includes an opening through which the conductive line passes.

7. The X-ray generation apparatus according to claim 6, wherein a side surface of the opening and an inner side surface of the second portion form a continuous surface without a step.

8. The X-ray generation apparatus according to claim 6, wherein the insulating member includes a tubular portion and a flange portion including a surface parallel to the plate portion, and one end of the tubular portion and the flange portion are connected to each other.

9. The X-ray generation apparatus according to claim 1, further comprising a regulating member configured to fix or limit a position of a portion of the entire conductive line, which is between two ends of the conductive line.

10. The X-ray generation apparatus according to claim 9, wherein the regulating member comprises an insulator.

11. The X-ray generation apparatus according to claim 10, wherein the regulating member is connected to the insulating member.

12. The X-ray generation apparatus according to claim 1, wherein the insulating liquid is arranged to surround the voltage supply.

13. The X-ray generation apparatus according to claim 1, wherein the voltage supply includes a power supply circuit, and a driving circuit that receives power supplied from the power supply circuit and drives the X-ray generation tube via the conductive line.

14. The X-ray generation apparatus according to claim 13, further comprising a conductive member arranged in the first space to surround the driving circuit.

15. The X-ray generation apparatus according to claim 14, wherein the insulating liquid is arranged to surround the conductive member.

16. An X-ray imaging apparatus comprising:

the X-ray generation apparatus of claim 1; and an X-ray detection apparatus configured to detect X-rays radiated from the X-ray generation apparatus and transmitted through an object.

* * * * *